United States Patent [19]

Petrovic et al.

[11] 4,430,161

[45] Feb. 7, 1984

[54] CASCADED COAL DRIER FOR A COKING PLANT

[75] Inventors: Vladan Petrovic; Karl Schmid; Friedrich Jokisch; Heinz Rotthaus, all of Essen, Fed. Rep. of Germany

[73] Assignee: Krupp-Koppers GmbH, Essen, Fed. Rep. of Germany

[21] Appl. No.: 376,843

[22] Filed: May 10, 1982

[30] Foreign Application Priority Data

May 13, 1981 [DE] Fed. Rep. of Germany ..... 3118931

[51] Int. Cl.[3] ..... C10B 39/02; C10B 57/10

[52] U.S. Cl. ..... 202/228; 34/177; 165/DIG. 27; 202/270

[58] Field of Search ..... 202/228, 270; 201/34, 201/39, 41, 31; 34/86, 169, 174, 177; 165/144, 146, 174, DIG. 27

[56] References Cited

U.S. PATENT DOCUMENTS

| | | | |
|---|---|---|---|
| 3,031,773 | 5/1962 | Dunkle | 165/144 |
| 3,043,752 | 7/1962 | Foch | 201/31 |
| 3,090,131 | 5/1963 | Waterman | 34/177 |
| 3,728,230 | 4/1973 | Kemmetmueller | 202/228 |
| 3,800,427 | 4/1974 | Kemmetmueller | 202/227 |
| 3,830,293 | 8/1974 | Bell | 165/174 |
| 3.843,458 | 10/1974 | Kemmetmueller | 201/31 |
| 4,080,181 | 3/1978 | Feistal et al. | 165/146 |
| 4,240,927 | 12/1980 | Karweil et al. | 201/31 |
| 4,246,071 | 1/1981 | Wagener et al. | 202/228 |
| 4,292,743 | 10/1981 | Razus | 34/177 |
| 4,308,102 | 12/1981 | Wagener et al. | 202/228 |
| 4,354,903 | 10/1982 | Weber et al. | 202/228 |

*Primary Examiner*—Bradley Garris

*Attorney, Agent, or Firm*—Michael J. Striker

[57] ABSTRACT

In a coking process, coal to be coked is preheated in a cascaded whirling bed drier into which the coal is charged from above and exposed to an indirect heat transfer while whirling in a coal-steam mixture. Hot gas applied to the heating pipes in respective cascades of the drier is branched off from the total amount of hot gases discharged from a dry cooler in which hot coke from the coke oven is cooled by recirculating cooler gas constituted by a partial gas stream discharged from the cascades of the drier and reunited with the other partial stream subject to a heat exchange for generating steam. Steam from the whirling beds is discharged from the cascaded drier, separated from the entrained dust particles, and then the excessive steam is drained in a branch conduit and the remaining steam is compressed and reintroduced into the lowermost whirling bed in the drier.

4 Claims, 4 Drawing Figures

CASCADED COAL DRIER FOR A COKING PLANT

BACKGROUND OF THE INVENTION

The present invention relates in general to a cascaded multi-stage whirling bed drier for use in a coking plant in which at least one coking oven is periodically charged with a preheated or preliminarily dried coal, and the produced coke is subjected to a dry cooling process, whereby the equipment for the dry cooling of the coke and for the preliminary heating of the coal are interconnected by means of a common gas recirculating circuit which transfers heat released from the hot coke during the cooling to the coal to be preheated.

A method of the aforedescribed type in which the devices for dry cooling of the coke and for preheating the coal are interconnected by a common gas circulating device is described for example in the U.S. Pat. No. 3,728,230. In this known method, hot gas emerging from the dry cooling for the coke after its cooling and dust removal, is introduced as a whole into the lower part of the coal preheater in such a manner that wet coal charged into the preheater from above is brought into the condition of a whirling bed. Gas exhausted from the upper part of the coal preheater is subsequently reintroduced into the lower part of the coke dry cooler. In this mode of operation, in which coal to be preheated is brought into intermediate contact with the gas from the coke dry cooler, considerable difficulties arise in practice already from the fact that the circulating gas stream, together with the entire contents of steam which the gas has entrained in the coal preheater, is fed back into the dry cooler for the coke. Due to the high contents of steam entrained in the recirculating gas, a considerable mass of water gas is generated on the red-hot coke. Consequently, this water gas reaction brings about not only an increased fire loss of the glowing coke but also the generated explosive water gas causes naturally considerable safety problems during operation.

SUMMARY OF THE INVENTION

It is therefore a general object of the present invention to overcome the aforementioned disadvantages.

More particularly, it is an object of the invention to provide an improved method of the aforedescribed kind which is not possessed of these disadvantages.

An additional object of the invention is to provide such a method which generally improves the operational conditions both during the preheating of the coal and during the dry cooling of the produced coke.

In keeping with these objects and others which will become apparent hereafter, one feature of the coking method of this invention for use in a plant including means for preheating or predrying coal to be periodically charged into at least one coking oven, means for dry cooling the produced coke by a gaseous cooling medium, whereby heat exchange between the hot coke and the coal to be preheated is effected by gas and steam recirculation in the provision of the following steps:

[a] preheating the coal by an indirect heat transfer in a cascaded multi-stage drier in which the coal is applied to whirling beds of coal-steam mixture;

[b] dividing the amount of gas exhausted from the dry cooling means into two partial streams, employing one of the partial streams for preheating the coal by passing the one stream at a temperature between 550° and 650° C. through the first stage of the cascaded drier and, after its discharge, reuniting the one stream with the other partial stream;

[c] recirculating the reunited two partial streams, after their purification and cooling, into the intermediate and lower zones of the dry cooling means; and

[d] maintaining the whirling beds in the cascaded drier by discharging used steam from the whirling beds, separating coal particles from the discharged steam, condensing and recompressing the latter, and recirculating the thus treated stream into the whirling beds.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
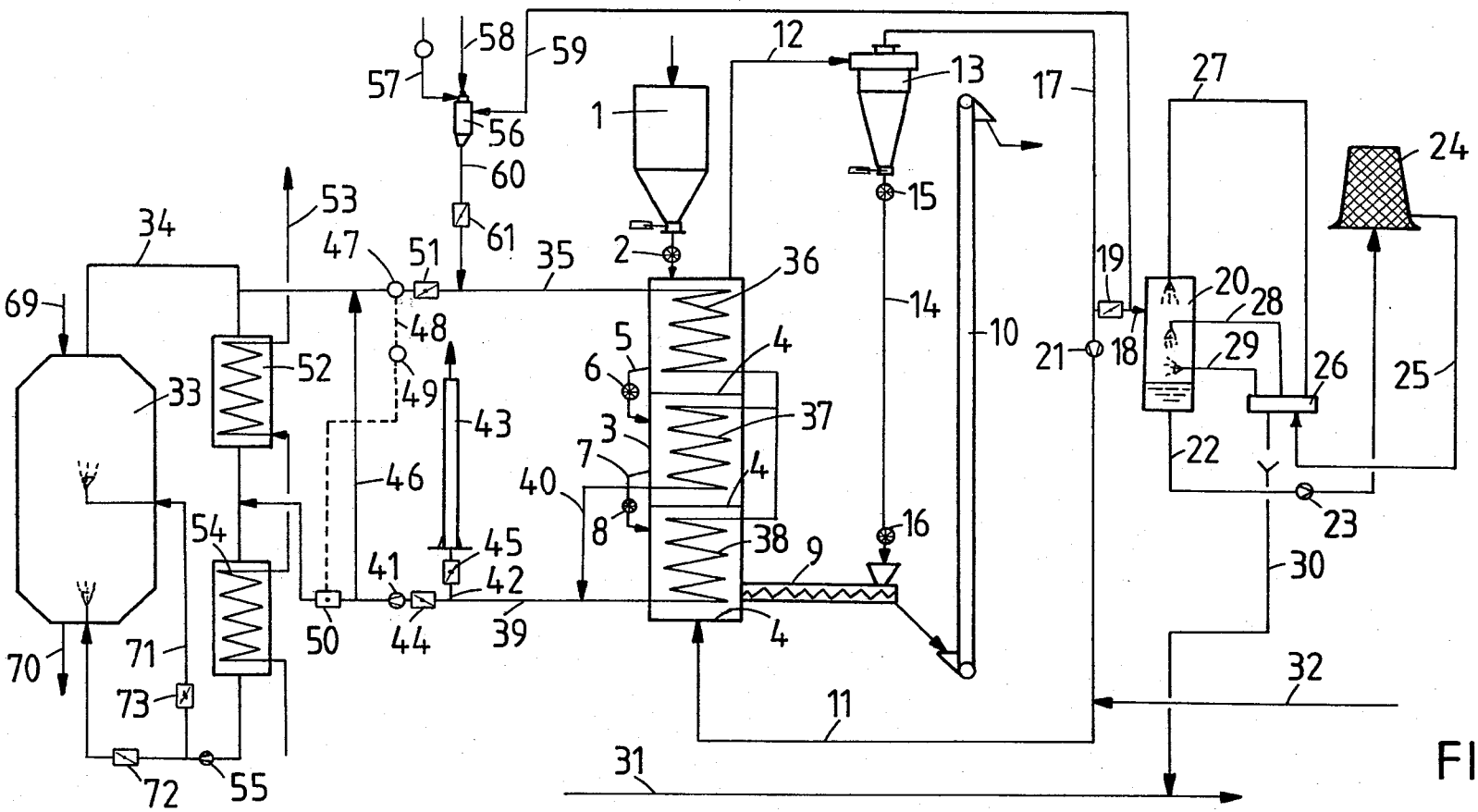
FIG. 1 is a schematic circuit diagram of a coking device shown with a flow diagram of the method of this invention.

Referring firstly to the flow diagram in FIG. 1, serving to explain the method of this invention in connection with an example of a coking plant, it will be noted that the latter is shown only to the extent of those units which are necessary for understanding this invention, whereas the remainder of the component parts of a complete coking plant are omitted.

Coal to be coked is discharged at a rate of about 100 tons per hour from a feeding container 1, which at its outlet is provided with a dosing bucket wheel valve 2, by means of which the coal is fed from above into a multi-stage or cascaded whirling bed drier 3. In this embodiment the multi-stage drier consists of three superposed cascades or stages, each being separated from the adjoining stage by means of a gas-permeable flow bottom 4. Naturally, the number of cascades is determined by moisture content and by the desired degree of drying or preheating of the charged coal. In the present example, the charged coal has a water content of 9%. In the first or uppermost cascade, coal is heated to about 80° C. and dried to a water content of about 1.5%. The partially dried coal is then transferred through conduit 5 with a bucket wheel valve 6 into the underlying second cascade. In this second cascade the coal reaches a temperature of about 150° C. and is further dried to a water content of about 0.5%. Thereafter, the coal is supplied through conduit 7, which is again provided with a bucket wheel valve 8, into the lowermost third cascade, in which the drying process is practically completed, so that about zero residual water content is achieved and the coal is heated to a temperature of about 200° C. At this temperature the dry coal is discharged from the whirling bed drier 3 and conveyed by means of a screw conveyor 9 and a chain conveyor 10 to a non-illustrated coal storing tower of the coking plant. Both the screw conveyor 9 and the chain conveyor 10 can be electrically heated in order to avoid heat losses. The whole conveying system is protected against penetration of steam from the cascaded whirling bed drier 3.

This steam is introduced into the drier from below through conduit 11 and the free stream bottom 4 of the lowermost or third cascade at a pressure of about 2 bar and a temperature of about 200° C., so as to maintain the whirling beds of the coal-steam mixture in the drier. From the bottom of the drier the steam flows upwardly through the individual cascades and is discharged from the first or uppermost cascade at a temperature of about 140° C. The discharged stream flows through conduit 12 to a dust separator or cyclone 13 in which the entrained coal dust is separated and fed through conduit 14 and bucket wheel valves 15 and 16 into screw conveyor 9 where it is admixed to the dried and preheated coal. The separated steam, devoid of coal dust, is withdrawn at the top of cyclone 13 through a conduit 17. Due to the separation of additional steam from the wet coal, the main stream of steam during its passage through the superposed cascades absorbs this additional steam, it is necessary to remove the excess steam from circulation by partial condensation. For this purpose, a partial stream is branched off from the conduit 17 via a regulating valve 19 and a branch conduit 18 and is fed into a washer 20 where the excess steam is condensed. The major stream in conduit 17, however, is fed through compressor 21 in which the steam is recompressed to about 2 bar, the steam being simultaneously heated again to about 200° C. In this condition the steam is again fed back through conduit 11 into the bottom of the cascaded drier 3. In this manner the recirculating circuit is closed. If desired, an inert gas can be fed through conduit 32 into the recirculating circuit.

The smaller partial stream of steam tapped off through conduit 18 is introduced, as mentioned above, into the recirculating washer 20 in which it is compressed and simultaneously purified of coal particles. Liquid discharged from washer 20 is supplied through conduit 22 and pump 23 into a cooling tower in which it is cooled down to a temperature of about 40° C. The cooled liquid is then supplied through conduit 25 into cool water distributor 26, from which the cool water is distributed through conduits 27, 28, 29 to different levels of the recirculating washer 20. Discharge conduit 30 serves for withdrawing excessive water from the distributor 26 and delivers the same into a waste water channel 31. A non-illustrated waste water treatment device can be connected to conduit 22 between the recirculating washer 20 and the cooling tower 24. Solid particles separated from the waste or drain water include a high component of fine coal particles and can be either stored in a depot or burned.

Hot streams of gas escaping at a temperature of about 800° C. at the upper part of the coke dry cooler 33 are passed off through conduit 34 into waste heat boilers 52 and 54 as will be explained below. A branch conduit 35 taps off a partial stream of gas from the main stream in the conduit 34 and passes the partial hot stream into the cascaded multi-stage whirling bed drier 3, where it is employed for an indirect heat transfer to the coal to be preheated. This partial stream in the branch conduit 35 contains about 50% by volume of the entire amount of gas discharged from the cooler 33 and arrives at a temperature of about 600° C. into the heating pipe 36 of the first (uppermost) cascade of the whirling bed drier 3. After passage through the heating pipe 33, the partial gas stream still has a temperature of about 400° C. and is again branched into two parallel partial streams. One partial stream is fed through heating pipe 37 into the second (intermediate) cascade, and the other partial stream in the heating pipe 38 into the third (lowermost) cascade. The partial stream discharged from the lowermost cascade at a temperature of about 288° C. is passed off into a return conduit 39. In this return conduit 39 there opens also a discharge conduit 40 from the outlet of the heating pipe 37 of the intermediate cascade, and the return partial gas stream of conduit 40 having a temperature of about 266° C. is mixed with the stream of gas in the return conduit 39, and the combined stream of gas is fed back through regulating valve 44 and blower 41 into the conduit 34. Upstream of the valve 44 a branch conduit 42 with a regulating valve 45 is connected to the return conduit 39 to discharge a certain amount of the return stream of the gas, adjusted by the valves 44 and 45 through the stack 43 in the outer atmosphere. In addition, downstream of the blower 41 there is also provided a bypass conduit 46 interconnecting the return conduit 39 with the intake branch conduit 35. This bypass conduit 46 serves for the admission of cool gas from the return conduit 39 into the branched partial stream of hot intake gas in the conduit 35 to regulate the temperature of the latter. For this purpose, a temperature sensor is arranged in conduit 35 downstream of the bypass conduit 46. The temperature sensor is electrically connected through conduit 48, indicated by dashed lines, to an electrical control device 49, which in dependence upon a preset desired temperature value controls a regulating valve 50 in the gas return conduit 39. The control valve 50 is operated by a motor in such a manner that, in response to a gas temperature drop sensed by the sensor 47 below a nominal value adjusted in the control device 49, the latter actuates the motor to open the valve 50, so that an increased amount of cooler gas from return conduit 39 passes through boiler 54 into the bottom part of the cooler 33, and consequently a correspondingly increased amount of hot gas is discharged through conduit 34 into the branch conduit 35. At the same time, the amount of cooler gas passing through bypass conduit 46 into the branch conduit 35 is correspondingly decreased. As a result of this combined action, the gas temperature in the branch intake conduit 35 is increased. On the other hand, if the gas temperature read in sensor 47 exceeds the preset nominal value, then the motor-driven regulating valve is correspondingly throttled, thus causing a reduced supply of gas into the coke cooler 33 and simultaneously an increased supply of cool gas through bypass conduit 46 into the intake branch conduit 35 until again the gas temperature in the latter conduit is lowered to the desired value. The motor-driven regulating valve 51 is also provided downstream of the temperature sensor 47 in the branch conduit 35.

As mentioned above, the partial stream of hot gas conducted in conduit 34 is combined with the cooler return gas from conduit 39 and recirculated into the dry cooler 33 which serves for cooling hot coke produced in a non-illustrated coke oven battery. This hot coke is charged through conduit 69 into the upper part of the coke dry cooler 33, whereas the cooled down coke is discharged from the lower part of the latter through conduit 70. The conduit 34 contains also non-illustrated devices for separating dust particles from the hot gas stream and is connected to the aforementioned waste heat boilers 52, 54 where the hot partial stream discharged from the coke dry cooler 33 is cooled down to a temperature of about 150° C. The two waste heat boilers 52 and 54 are interconnected by a pipe system 53 which serves for feeding in water and discharging steam. The connection of the cooled partial stream from the conduit 39 into the conduit 34 is made between the two waste heat boilers 52 and 54, so that the reunited partial streams of gas pass together through the lower waste heat boiler 54, where they cool down to a temperature of about 150° C. and, by means of a blower or condensor 55, are compressed to the operational pressure of the dry cooler 33. At the outlet of compressor 55 a branch conduit 71 with a regulating valve 73 is connected to the conduit 34 to introduce a partial stream of gas into the intermediate part of the dry cooler 33, in which the treated coke still has a temperature of about 400°-600° C. The remaining portion of the return gas is fed simultaneously, in a conventional manner, into the bottom part of the dry cooler 33. An additional control valve 72 is provided in conduit 34 downstream of the compressor 55 so as to regulate, together with valve 73 in branch conduit 71, the flow of both partial streams in such a manner that pressure losses of gases in dry cooler 33 be reduced. Moreover, this regulation enables favorable adjustment of the temperature differences between the employed gas and the treated coke. This adjustment in turn results in an improved adjustability both of the gas intake and of the heat transfer from the cooled coke.

In addition, there is also provided a combustion chamber 56 as safety means for preventing an interruption in the coal preheating in the cascaded whirling bed drier 3 in the event of operational disability or interference in the coke dry cooler 33. The combustion chamber 56 is supplied through conduit 57 with a gaseous, liquid or solid fuel and through conduit 58 with the required oxygen (air). Since hot flue gases generated in the combustion chamber attain an excessively high temperature of about 1400° C., steam tapped off from conduit 18 is supplied into the combustion chamber through conduit 59. By means of this addition of steam, the temperature of flue gases can be reduced to a desired value of about 600° C., and gas at this temperature is fed through conduit 60 in the intake gas conduit 35. A regulating valve 61 is arranged in the conduit 60 so that the addition of gas can be controlled in such a manner that the emergency combustion chamber 56 could also be employed for the heat addition even during normal operation of the dry cooler 33.

Figure 3:
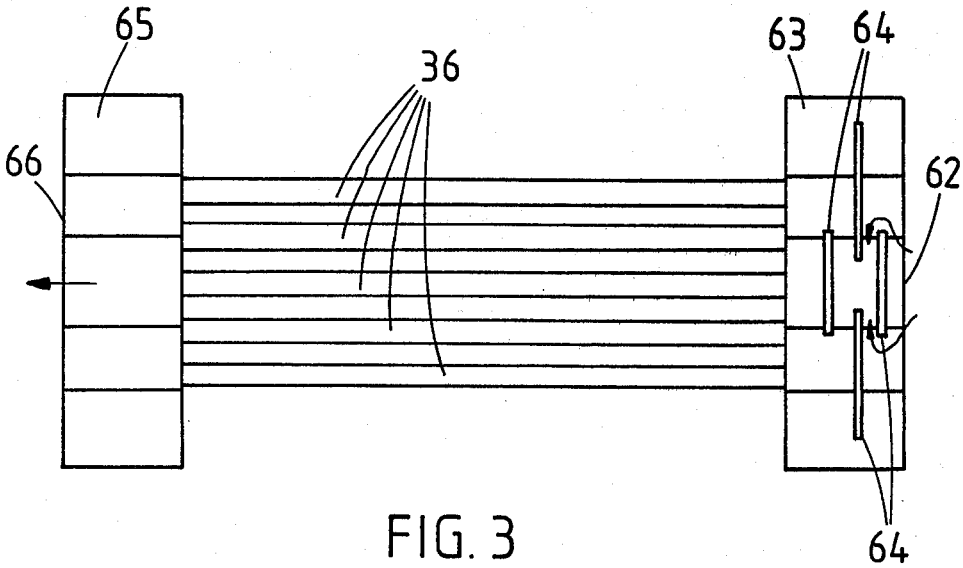
FIG. 3 is a plan view of the cascade of FIG. 2.
Figure 4:
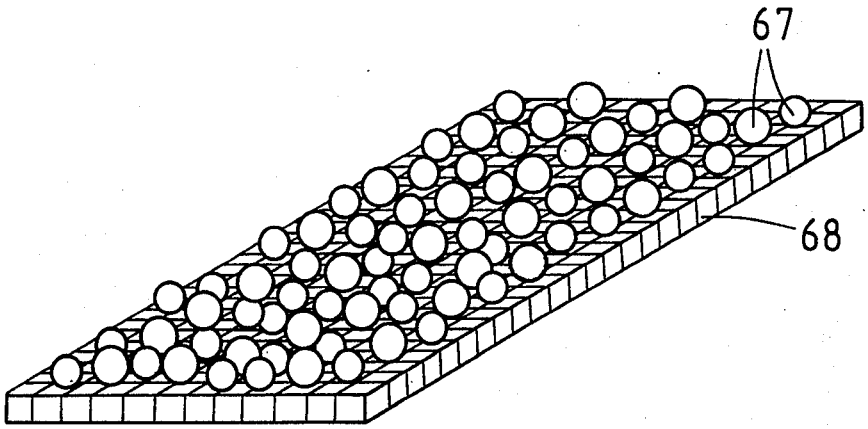
FIG. 4 is a schematic perspective illustration of an embodiment of a flow-in bottom in a cascaded multi-stage whirling bed drier.

Structural details of a special construction of the cascaded whirling bed drier 3 will now be explained in connection with FIGS. 2–4, which have proven to be advantageous in carrying out the method of this invention.

Figure 2:
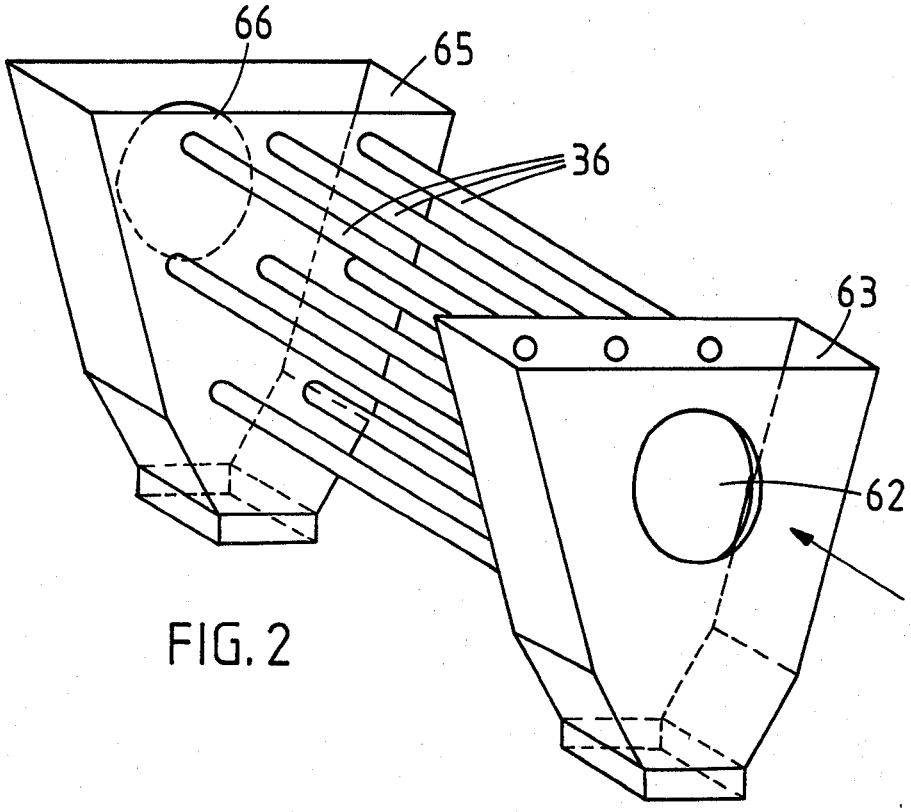
FIG. 2 is a perspective view of one stage or cascade of a multi-stage whirling bed drier for carrying out the method of this invention.

FIG. 2 shows a stage or cascade of the drier 3 provided with horizontally oriented heating pipes. Hot gas fed through a non-illustrated intake conduit enters through opening 62 a distributing box 63, in which baffle plates 64 (FIG. 3) are arranged. The baffle plates 64 serve to uniformly distribute the incoming gas stream, and at the same time partially separate entrained gas particles from the gas. The separated dust is collected in the converging bottom part of the distributing box 63 and is removed from time to time therefrom. From the distributing box 63 the gas passes through the horizontal heating pipe which, in the case of the first or uppermost cascade corresponds to pipe 36. It will be noted that the remaining cascades have the same arrangement of heating pipes 37 and 38. As regards the diameters of heating pipes in respective cascades, it has proven most advantageous when the pipes in the first (uppermost) cascade exceed in diameter the heating pipe in the underlying cascade. For example, the outer diameter of heating pipes in the first cascade amounts to 60.3 mm, whereas the outer diameter in the second and the third cascade is 48.3 mm. In any event, the diameter of pipes should be selected such that an average flow rate of about 20 meters per second is achievable in every cascade. It has been found, in particular, that at this gas flow rate no substantial dust deposits will occur on the inner walls of the heating pipes. In order to further improve the effectiveness of the heat exchange, the outer side of the heating pipe can be profiled, for example the outer surface of the pipe being provided with fins. Coal to be heated flows, as described above, from above downwardly past the outer surface of the heating pipes.

After passage through the heating pipes 36, hot gas reaches collecting box 65, from which it is discharged through opening 66 in a non-illustrated discharge conduit leading either to the underlying cascade or to the return conduit 39. This particular construction of heating pipes has the advantage that when a heating pipe is accidentally broken, the corresponding outlets in the distributing and collecting boxes 63 and 66 can readily be closed, and the entire device can be thus quickly returned to its normal operation. Even when a whole cascade breaks down, the operation of the remaining cascades is not disturbed. The individual cascades or stages are made of wear-resistant steel and from the outside can be reinforced by profiled iron. All cascades are installed in a housing which normally consists of a steel frame structure provided with wall plates which are thermally insulated from the outside. Furthermore, the superposed cascades are interconnected by thermal expansion compensating means which neutralize different thermal effects and also prevent the propagation of vibrations. The inner walls of the housing in the range of each cascade also converge downwardly, so that stream bottoms 4 have smaller areas than the cross sections of the adjoining upper and lower parts of the housing.

As already explained in connection with FIG. 1, coal to be preheated or dried is charged in the cascaded drier 3 from above, so that the coal stream passes downwardly from the uppermost cascade into the lowest one. The housings of superposed cascades are separated one from the other by the gas-permeable free stream bottom 4. The purpose of the free stream bottoms is the provision of a uniform distribution of steam at the inlet of the coal-steam whirling layer in each cascade. In order to ensure the uniform fluidization of the coal, it is necessary that pressure loss at the free stream bottom be about 10 to 15% of the pressure loss in the coal-steam whirling layer. This condition can be fulfilled in simple manner by the provision of a bar grate 68 shown in FIG. 4. The bar grate 68 is charged with coarse coal granules 67 of grain size larger than 40 mm. In a modification, it is also possible to employ the so-called sandwich-type bottom consisting of two superposed and mutually staggered bar grates with a gas-permeable filling material sandwiched therebetween.

In summary, the method of operating a coking plant according to this invention has the following advantages:

(a) preservatory drying and preheating of coal in a steam atmosphere, by means of which overheating of coal particles which is detrimental to coking quality is largely avoided;

(b) increased temperature difference and high heat transfer rate between the hot gas and the coal-steam whirling layer;

(c) advantageous combination of contact-type drying and convection-type drying;

(d) reduced discharge of flue dust from the individual cascades of the multi-stage whirling bed drier;

(e) favorable operational conditions during the dry cooling of the coke with minute pressure losses and a good adjustability;

(f) increased flexibility of the whole device and (g) low-pressure machinery requiring low investment and low operational costs, and small installation space.

It will be understood that each of the elements described above, or two or more together, may also find a useful application in other types of constructions differing from the types described above.

While the invention has been illustrated and described as embodied in a specific example of a coking device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In combination, a coking plant including means for preheating and drying coal to be charged into at least one coking oven, and means for dry cooling by a gaseous cooling medium hot coke after its discharge from the coking oven, whereby heat exchange between the hot coke and the coal to be preheated is effected by recirculating gas and steam generated during the cooling process between said preheating means and said dry cooling means, and multi-stage cascaded drier arranged in said preheating and drying means for receiving in its uppermost cascade coal to be preheated and for discharging the coal at its lowermost cascade, said cascaded drier including in each cascade a gas distributing box and an opposite gas collecting box, an array of parallel-connected and substantially horizontally oriented heating pipes interconnecting said boxes, and said heating pipes in the uppermost cascade having larger diameters than the pipes in the underlying cascades.

2. The combination as defined in claim 1, wherein said gas distributing box is provided with a plurality of upright baffle plates.

3. The combination as defined in claim 1, wherein the outer surface of said heating pipes is provided with fins.

4. The combination as defined in claim 1, wherein the bottom of each cascade is in the form of a bar grate for being charged with coarse piece coal of a grain size larger than about 40 mm.

* * * * *